US005697237A

United States Patent [19]

Dilger et al.

[11] Patent Number: 5,697,237

[45] Date of Patent: Dec. 16, 1997

[54] ELECTRIC MOTOR DRIVEN OPERATING DEVICE

[75] Inventors: Werner Dilger, Buehl; Friedrich-Wilhelm Dreier, Sinzheim, both of Germany

[73] Assignee: Robert Bosch GmbH, Stuttgart, Germany

[21] Appl. No.: 599,818

[22] Filed: Feb. 12, 1996

[30] Foreign Application Priority Data

Mar. 7, 1995 [DE] Germany ..... 195 08 026.2

[51] Int. Cl.[6] ..... E05B 47/00

[52] U.S. Cl. ..... 70/264; 70/277; 70/279; 74/54; 74/89.14; 292/201; 292/336.3

[58] Field of Search ..... 70/264, 275, 277, 70/279, 280; 292/336.3, 201, 142, 144; 74/54, 89.14

[56] References Cited

U.S. PATENT DOCUMENTS

| | | | |
|---|---|---|---|
| 4,272,112 | 6/1981 | Schlick et al. | 292/201 |
| 4,573,723 | 3/1986 | Morita et al. | 292/336.3 |
| 4,779,912 | 10/1988 | Ikeda et al. | 292/336.3 |
| 4,793,640 | 12/1988 | Stewart, Sr. | 292/336.3 X |
| 5,240,296 | 8/1993 | Kobayashi | 292/201 |
| 5,419,596 | 5/1995 | Okada et al. | 292/336.3 X |
| 5,564,308 | 10/1996 | Hoshikawa et al. | 292/336.3 X |
| 5,582,448 | 12/1996 | Inoue | 292/336.3 |

*Primary Examiner*—Lloyd A. Gall
*Attorney, Agent, or Firm*—Michael J. Striker

[57] ABSTRACT

An electric motor operated actuating device for a blocking button of a door lock for central locking and unlocking of doors of a motor vehicle comprises an electric motor actuatable by a door key and provided with a driven shaft, a turning lever connectable with the blocking button for transferring the blocking button to a blocking position which locks the door lock and to an unblocking position which releases the door lock, a transmission including a turning member with a coulisse and a driver rotatable about a rotary axis and provided with a driver cam which runs in the coulisse. The coulisse is formed so that the turning member in each end rotary position of the driver cam is turnable by manual actuation of the blocking button through the turning lever by the driver cam to one of the two end turning positions, and during rotation of the driver cam from the one end rotary position to another end rotary position is turned to one or another end turning position.

10 Claims, 2 Drawing Sheets

Fig. 1
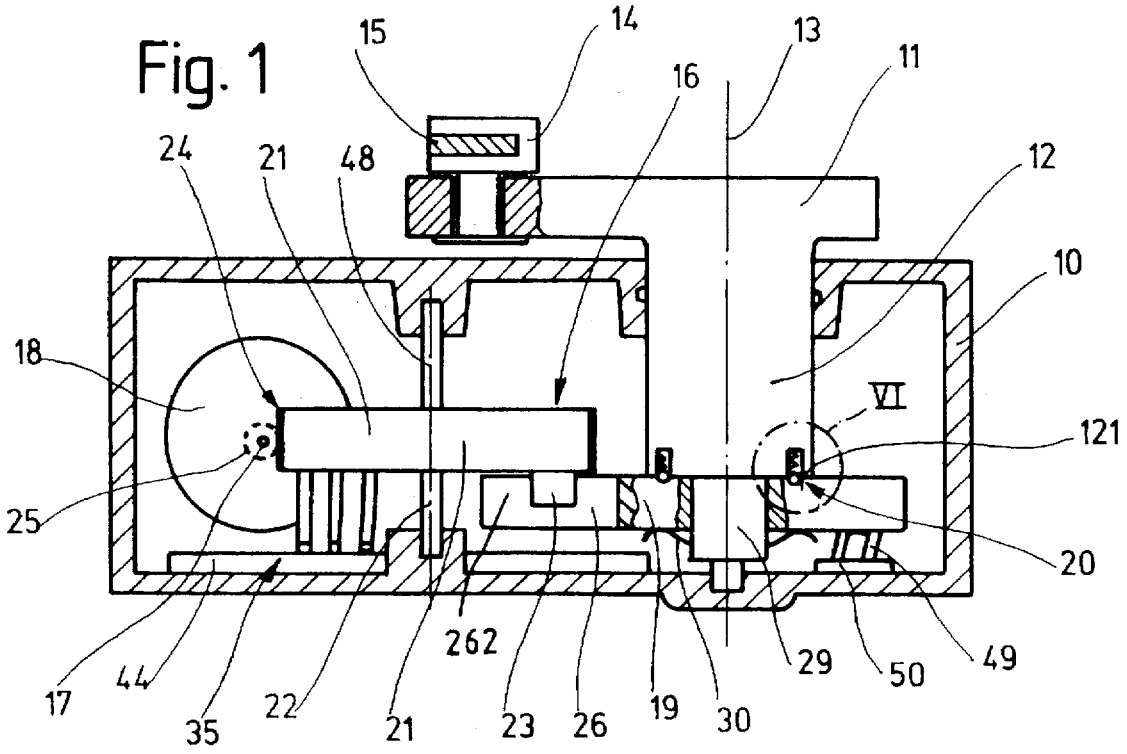
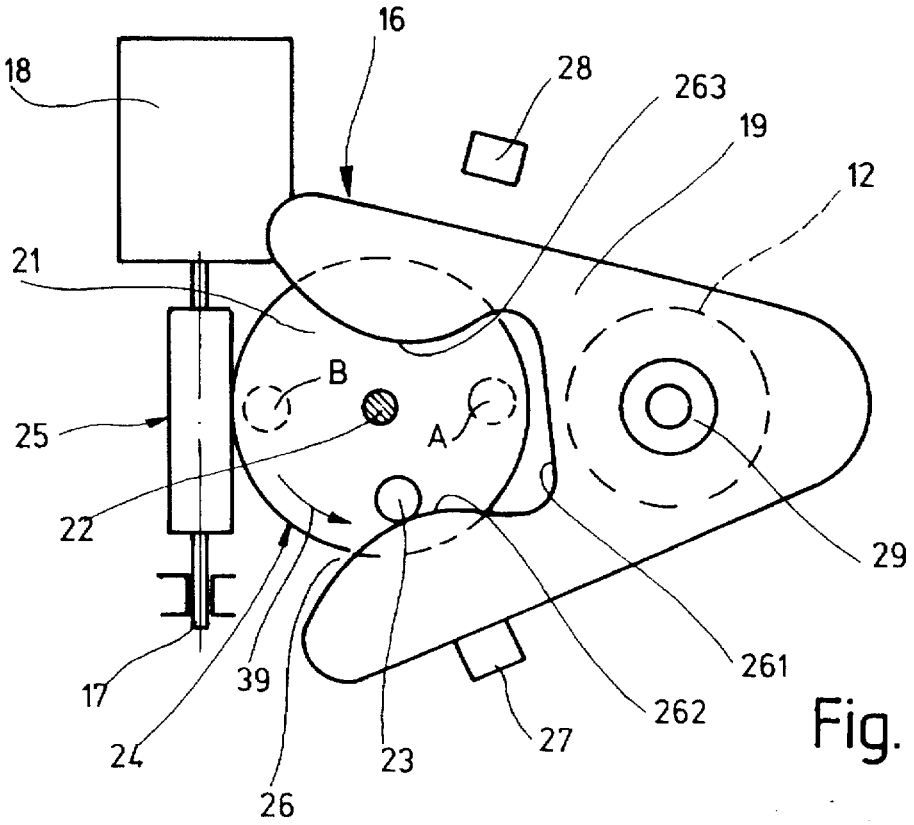
Fig. 2

ELECTRIC MOTOR DRIVEN OPERATING DEVICE

BACKGROUND OF THE INVENTION

The present invention relates to an electric motor driven operating device for blocking button of a door lock for central locking and unlocking of the doors of a motor vehicle.

A central locking for the door lock of motor vehicle doors with an electrical position control is disclosed for example in the German patent document DE 40 15 522 A1 or DE 42 22 868 A1. The locking and unlocking buttons operate for manually locking individual door locks from opening, so that the doors can be opened only after the preceding unlocking of the locking or unlocking button. The unlocking is performed manually both by direct gripping of the blocking button and also by a door key through a linkage which is operated by the key and engages with the blocking button.

In known door closing arrangements of motor vehicles, each door lock is associated with an electric motor operated actuating device for additionally actuating the locking and unlocking button by an electric motor. This provides for the possibility of a simple central locking by electric control of the actuating devices by a single door lock, and thereby all electric motors of the actuating devices are started. Each electric motor transfers, through the transmission, the associated blocking button in its blocking or locking position in which it blocks the door lock or in its unlocking position in which it releases the door lock. When the blocking or locking button, which can be actuated manually is transferred by hand in its another position, the transmission together with the driven shaft and the rotor of the electric motor is moved. Thereby the force application during the handling of the blocking button is substantially increased, and therefore at least for the vehicles of the luxury class a reduced comfort must be taken into consideration.

SUMMARY OF THE INVENTION

Accordingly, it is an object of the present invention to provide an electric motor driven actuating device of the above mentioned general type, which avoids the disadvantages of the prior art.

In keeping with these objects and with others which will become apparent hereinafter, one feature of the present invention resides, briefly stated, in an electric motor driven actuating device for a blocking button of a door lock, in which the transmission has a turning member which is turnable about a turning axis of a turning lever and is connected for joint rotation with the turning lever and also has a driver which is driven by the electric motor and is rotatable about a rotary axis extending parallel to the turning axis with a driver cam arranged at a radial distance from the rotary axis and rotates during rotation of the driver in a coulisse in the turning member, an end switch is provided which turns off the electric motor when after rotation of the driver by approximately 180° the driver cam assumes one of two end rotary positions located on a straight line intersecting the rotary axis of the driver and the turning axis of the turning member and the turning lever, and the coulisse is formed so that the turning member in each end rotary position of the driver cam is turnable by manual actuation of the blocking bottom through the turning lever unobjectionably by the driver cam in one of the two end turning positions, and during rotation of the driver cam from its one end rotary position to its another end rotary position is turned in one or another end turning position.

When the electric motor operated actuating device is designed in accordance with the present invention, it has the advantage that the electric motor with the transmission is uncoupled from it during the manual actuation of the blocking button and must not be moved and thereby the required easy running of the blocking button for the hand operation is provided. The utilized transmission parts provide for a compact construction and pose no requirements for the accuracy of manufacture. The support for the rotatable transmission parts can be designed in a cost favorable manner.

In accordance with a preferable embodiment of the invention, the connection of the turning member and the turning lever for joint rotation is performed by an overloading coupling which releases the rotary-fixed connection when a torque applied to the turning lever exceeds a predetermined value. With such an overloading coupling an emergency actuation of the blocking or locking button is ensured in the case of the current failure or a blocking of the turning member by the driver cam. The overload coupling can be released by increased force application and with the stationary turning member the turning lever is turned relative to it so that the blocking button can be transferred to its blocking or unblocking position. In the same manner, the blocking button can be actuated by the door key with increased force application for releasing the overloading coupling.

In accordance with a further embodiment of the invention, such an overloading coupling is preferably formed so that arresting elements and arresting recesses are arranged in the facing end surfaces of the turning lever and the turning member. The arresting elements engage in the arresting recesses under the spring force of arresting springs. Arresting recesses are formed so that the arresting elements can move out of the arresting recesses when the overload torque is applied to the turning lever, and thereby interrupt the connection between the turning lever and the turning member.

The end switch for switching the electric motor is needed for the positioning of the driver disc in its proper position in which the driver cam after rotation by 180° assumes one of its both end rotary positions. In accordance with another embodiment of the present invention the end switch can be formed by contact springs which are held on the driver disc and electrically connected with one another and also contact paths which are arranged stationarily relative to the driver disc and are electrically isolated from one another. The contact springs displace on the contact paths.

Preferably, the end switch has three concentrically arranged contact paths and a slider with three contact springs each contacting a respective one of the contact paths. One of the contact paths extends over a peripheral angle of 360° while both other contact paths extend over substantially 180° each and are arranged opposite to one another. In both end rotary positions of the driver disc a corresponding contact spring runs over the associated semi-circular contact path while the other contact spring runs over its associated semi-circular contact path. The electric motor which is formed as a direct current motor is connected with a full circle contact path and two direct voltage potentials, for example the minus potential. The both semi-circular contact paths can be connected by the door key selectively to the other direct voltage potential, for example the plus potential. A control electronic device and a sensor which senses the end turning positions of the turning member and supplies a check-back signal of the axial position of the turning member to the control electronic device are provided so that, after the manual actuation of the blocking button, its motor actuation is performed reliably to the other position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a longitudinal section of an electric motor operated actuating device for a blocking button of a door lock;

FIG. 2 is a view from below of the transmission of the actuating device of FIG. 1;

DESCRIPTION OF THE PREFERRED EMBODIMENTS

Figure 3:
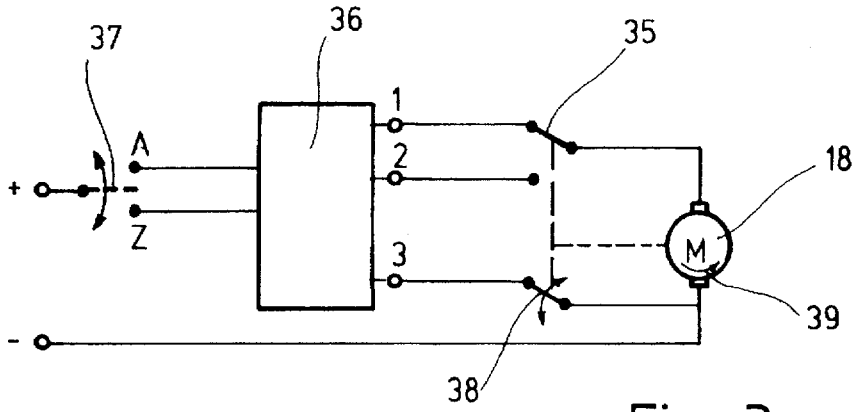
FIG. 3 is a principle electrical switching diagram of the actuating device of FIG. 1.

An electric motor operated actuating device for a blocking button of a door lock in accordance with the present invention is shown in a longitudinal section in FIG. 1 and has a housing 10. A turning lever 11 with a bearing pin 12 is turnably supported in the housing 10. The turning axis of the turning lever 11 is identified with reference numeral 13. An actuating member 14 for a connecting rod 15 to a not shown locking or blocking button of a door lock is turnably supported on the turning lever 11 at a radial distance from the turning axis 13. By turning the turning lever 11 to one or another turning direction, the blocking button is transferred through the connecting rod 15 to its two end positions, in which it locks in a known manner the associated door lock from opening or releases the same for opening. This both end positions of the blocking button are identified hereinbelow as blocking and unblocking positions.

For motor turning of the turning lever 11, it is connected through a transmission 16 with a driven shaft 17 of an electric motor 18. The electric motor 18 is formed as a direct current motor and rotates only in one direction. The transmission 16 is formed so that the rotation of the driven shaft 17 is converted into a turning movement of the turning lever 11 in one or another turning direction. The transmission 16 has a driver fork 19 arranged on the axis 13 of the turning lever 11 and connected with the turning lever 11 through an overloading coupling 20 for joint rotation therewith. It also has a driver disc 21 which is rotatable about a rotary axis 22 extending parallel to the turning axis 13 and carries a driver pin 23 arranged at a radial distance from its rotary axis 22. The driver disc 21 is driven by the electric motor 18 in the rotary direction identified with the arrow 39 and is formed for this purpose as a worm wheel 24 which engages with a worm 25 arranged on the driven shaft 17 of the electric motor 18. The driver fork 19 has a fork opening 26 and is turnable between two abutments 27 and 28 in opposite turning directions. When the abutment lever 19, as shown in FIG. 2, abuts against the lower end abutment 27 in FIG. 2, the turning lever 11 which is fixedly connected with the driver fork 19 is turned so fast that the blocking button is transferred to its end unblocking position. When to the contrary the driver lever 19 abuts against the upper end abutment 28, the turning lever 11 assumes such a turning position that the blocking button is located in its blocking position.

Figure 6:
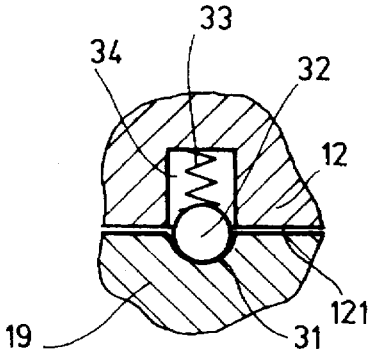
FIG. 6 is a view showing a section VI in FIG. 1 on an enlarged scale.

The driver lever 19 is arranged freely rotatably on an end portion 29 of the bearing pin 12 of a reduced diameter for a turning movement. It is pressed by a spring disc 30 against the end surface 121 of the bearing pin 12. An overloading coupling 20 located between the driver fork 19 and the bearing pin 12 of the turning lever 11 has a plurality of arresting openings 31 arranged in the driver fork 19 and the same number of arresting elements 32 arranged in the end surface 121 of the bearing pin 12. The arresting elements 32 engage in the arresting openings 31 under the force of an arresting spring 33. The arresting opening 31 and the arresting element 32 are located concentrically to the turning axis 13 in opposite surfaces of the bearing pin 12 and the driver fork 19. A fragment of the overloading coupling 20 is shown in FIG. 6 on an enlarged scale. As can be seen, the arresting openings 31 are formed as semi-spherical depressions in the driver fork 19, while the arresting elements 32 are formed as spheres which are guided and held in axial openings 34 in the bearing pin 12 and pressed into the arresting openings 31 by the arresting springs 33 which are formed as pressure springs. The flanks of the semi-spherical depressions which serve as the arresting openings 31 are formed so that when the driver fork 19 is blocked and stationary and a torque is applied to the turning lever 11, and exceeds a predetermined value, the spherical arresting elements 32 laterally move out of the arresting openings 31 and therefore interrupt the connection between the driver fork 19 and the turning lever 11.

The driver disc 21 is fixedly held on a shaft 48 which is coaxial to the rotary axis 22 and at its ends is received in bearings formed in the housing 10. The arrangement of the driver disc 21 is selected so that its rotary axis 22 is located inside a fork opening 26 formed as a coulisse for controlling the driver fork 19, while the driver cam 23 is rotated on the one hand over the base 261 of the fork opening 26 and exits from the fork opening 26 on the other hand. In these two end rotary positions of the driver cam 23 identified in broken line in FIG. 2 and provided with references A and B, which positions are located on straight line intersecting the turning axis 13 of the turning lever 11 and the rotary axis 22 of the driver disc 21, the electric motor 18 is turned off by an end switch 35. The inner flanks of the driver fork 19 which limit the fork opening 26 along both fork prongs are formed as control curves 262 and 263 cooperating with the driver cam 23. They are convex so that the driver fork 19 during sliding of the driver cam 23 on the control curve 262 is transferred to its one end turning position defined by the abutment 27, and during sliding of the driver cam 23 on the control curve 263 is transferred to its another end turning position defined by the abutment 28. The fork opening 26 is formed at the base 261 so wide in a turning direction, that with the driver cam 23 located before the base 261 the driver fork 19 can perform a turning movement which is not prevented by the driver cam 23, to its both end turning positions defined by the abutments 27 and 28.

The electric diagram of the actuating device is shown in FIG. 3. The control electronic circuit 36 has three inputs A, Z and 3 as well two outputs 1 and 2. The electric motor 18 is connected with the minus potential of the direct voltage source and also, through the end switch 35 is connected with the output 1 or 2 of the control electronic circuit 36, depending on the rotary position of the driver disc 19. Both inputs A and Z of the control electronic circuit 36 are connected with the plus potential of the direct voltage source selectively by a door key 37 which is shown symbolically as a switch. When the door key 37 is connected with A, the output 1 is at the plus potential, while when the door key 37 is at Z the output 2 is at the plus potential. The third input 3 of the control electronic circuit 36 is connected through a so-called position switch 38 with the minus potential. The position switch 38 indicates the control electronic circuit 36 in accordance with the position of the driver fork 19. When the driver fork abuts against the end abutment 28, the position switch 38 is closed. During turning back of the driver fork 19 from the end abutment 28, the position switch 38 opens.

Figure 4:
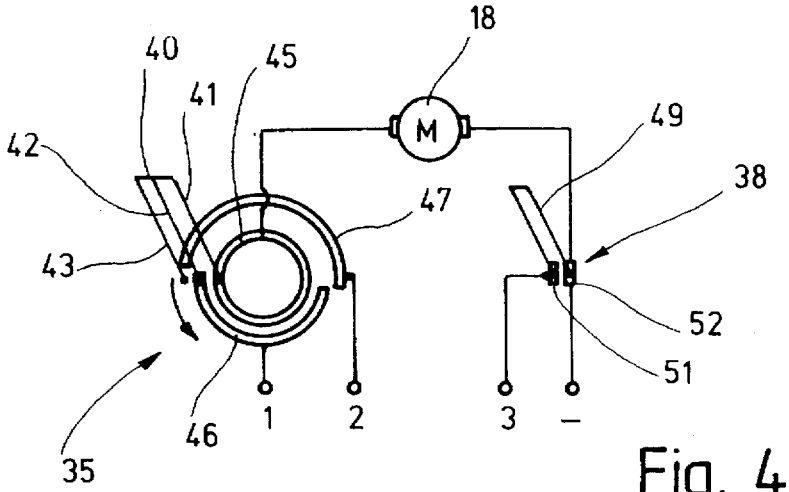
FIGS. 4 and 5 each show a plan view of the construction of an end and position switch of FIG. 3 in two different switching positions.
Figure 5:
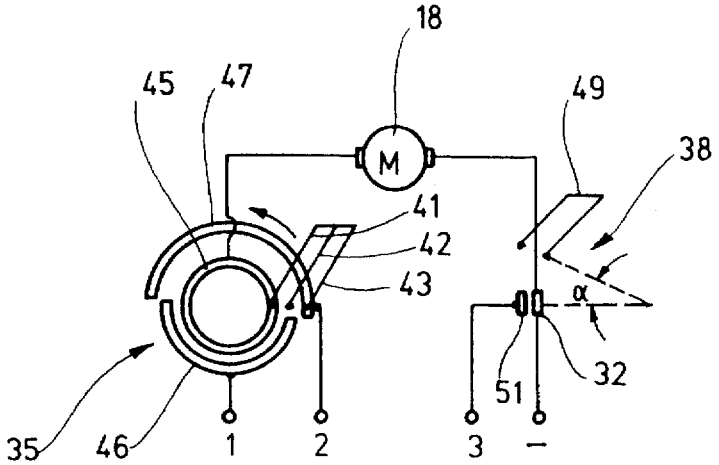

The construction of the end switch 35 and the position switch 38 is shown in FIGS. 1 and 4, 5. The end switch 35 has a slider 40 with three electrically connected contact springs 41, 42, 43 and three concentrically arranged contact pairs 45, 46, 47 on which the contact springs 41, 42, 43 correspondingly slide. The slider 40 with the contact springs 41, 42, 43 is mounted on the driver disc 21 as shown in FIG. 1, while the concentric contact path 45, 46, 47 which are cut from a plate 44 formed as a punched grate are arranged on the housing 10 isolated from one another. Their contact paths extend over a circumferential angle of 360° and form a closed circular path while both other contact pairs 46, 47 extend over a circumferential angle of substantially 180° each and arranged opposite to one another. The arrangement of both semi-circular contact paths 46, 47 is selected so that the rotary position of the driver disc 21 in which the driver cam 23 assumes its end rotary position A or B shown in dash-dot line in FIG. 2, a corresponding contact spring 42 and 43 runs over the associated semi-circular contact paths 46 or 47, and the contact springs 43 or 42 run over its associated semi-circular contact paths 47 or 46. As can be seen from FIG. 5, in the end rotary position A of the driver cam 23, the contact spring 41 runs over the associated contact path 45 and the contact spring 43 runs over the associated contact path 47. As shown in FIG. 4 in the end rotary position B of the driver cam 23 the contact spring 43 runs over its contact path 47 and the contact spring 42 runs over its associated contact path 46.

The position switch 38 which senses the end turning position of the driver fork 19 independently from the rotary position of the driver disc 21 and supplies a check back signal to the control electronic circuit 36. It has a contact bridge 49 arranged on the driver fork 19 and two contacts 51 and 52 which are cut from a punch grate plate 50 shown in FIG. 1. The contacts 51 and 52 are connected with the input 3 of the control electronic circuit 36 or with the minus potential of the direct voltage source. The contacts 51, 52 are arranged in the housing 10 so that the contact bridge 49 during abutment of the driver fork 19 against the abutment 28 contacts both contact bridges 51, 52 and during turning back of the driver fork 19 from its abutment 28 is lifted from both contact bridges 51, 52.

The above described actuating device operates in the following manner:

In an initial position the blocking button is located in its blocking position, the driver fork 19 abuts against the abutment 28, and the driver disc 21 assumes such a rotary position that the driver cam 23 is located in the end rotary position B in FIG. 2. The end switch 35 assumes the position shown in FIG. 4, in which both contact paths 45 and 46 are connected with one another through the contact springs 41 and 42 of the slider 40. The position switch 35 assumes the position shown in FIG. 4 because of the driver fork 19 abutting against its abutment 28. In this position both contacts 51, 52 are connected with one another by a contact bridge 49. This initial position of the actuating device is shown in FIG. 3.

When the blocking button must be unlocked for releasing the door lock for opening of the vehicle door, then by means of the door key 37 the input A of the control electronic circuit 36 is connected with the plus potential. Thereby the output 1 of the control electronic circuit 36 is connected to the plus potential and the electric motor 18 rotates in direction of the arrow 39 in FIG. 2. Thereby the driver disc 21 also rotates in direction of the arrow 39 in FIG. 2. The driver cam 23 runs over the control curve 262 and turns the driver fork 19 during the running over the control curve 262 so far until it abuts against the abutment 27. During turning of the driver fork 19 from the definite end turning position defined by the abutment 28, the contact bridge 49 of the position switch 38 is lifted from the contacts 51, 52. After turning of the driver cam 23 to its end rotary position A in FIG. 2, the contact spring 42 leaves the associated contact path 46 and the contact spring 43 runs over the contact path 47 as shown in FIG. 5. As can be seen from FIG. 3, the end switch 35 is turned thereby to another turning position in which the electric motor 18 is connected with the output 2 of the control electronic circuit 36 and the position switch 38 opens. With switching over of the end switch 35, the electric motor 18 is turned off and the driver disc 21 is stopped. The blocking button is unlocked. This situation is shown in FIG. 5 wherein the turning angle of the driver fork 19 is identified as $\alpha$.

When the blocking button is again transferred to its blocking position, or in other words the associated door lock is locked against opening, the input Z of the control electronic circuit 36 is connected with the plus potential by the door key 37. The output 2 of the control electronic circuit 36 is transferred to the plus potential, and the end switch 35 located in a position of FIG. 5 again turns on the electric motor 18. The driver disc 21 is rotated by 180° in direction of the arrow 39. The driver cam 23 slides along the control curve 263 and thereby turns the driver fork 19 back to its end turning position defined by the abutment 28. The position switch 38 is closed, and the turning lever 11 which turns with the driver fork 19 transfers the blocking button to its blocking position. The electric motor 18 rotates further until the driver cam 23 reaches its end rotary position B, the contact spring 43 is lifted from the contact path 47, and the contact spring 42 again runs on the contact path 46. As can be seen from FIG. 3, the end switch 35 turns again back to the position shown in FIG. 3. The current circuit to the output 2 of the control electronic circuit 36 is interrupted and the electric motor 18 is turned off. The end switch 35 and the position switch 38 assume their position shown in FIGS. 3 and 4.

When in the end rotary positions A or B of the driver cam 23 the blocking button is transferred by hand to its blocking or unblocking position, then because of the turning of the driver fork 19 connected therewith, the position switch 38 is actuated which leads to a change of the check back signal at the third input 3 of the control electronic circuit 36. When now the position of the blocking button must be again changed by a motor, the control electronic circuit 36 controls through its outputs 1 and 2 the electric motor 18 so that it is turned on and the driver disc 21 transfers the driver cam 23 first to the corresponding end rotary position B or A, from which it can perform the transfer process of the blocking button by turning of the driver fork 19.

It should be mentioned that in multi-door vehicles in which each vehicle door is provided with a door lock and the above described actuating device for the blocking button of the door lock, all actuating devices are controlled from a single door lock by the door key 37. In different positions of the different door locks, they are transferred during actuation of the door key 37 first to a common position. After this, the desired blocking and unblocking process of the door lock is performed by transferring the blocking button to the corresponding blocking or unblocking position. The signal of the switch 38 can be utilized by the control electronic circuit 36 so that the actuating devices of all vehicle doors are moved to a common position.

It will be understood that each of the elements described above, or two or more together, may also find a useful application in other types of constructions differing from the types described above.

While the invention has been illustrated and described as embodied in an electric motor driven operating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electric motor operated actuating device for a blocking button of a door lock for central locking and unlocking of doors of a motor vehicle, comprising an electric motor actuatable by a door key and provided with a driven shaft; a turning lever connectable with the blocking button for transferring the blocking button to a blocking position which locks the door lock and to an unblocking position which releases the door lock; a transmission arranged between said electric motor and said turning lever and converting a rotary movement of said driven shaft of said electric motor into a turning movement of said turning lever, said transmission including a turning member fixedly connected with said turning lever and turnable about a turning axis of said turning lever, and a driver driven by said electric motor and rotatable about a rotary axis extending parallel to said turning axis of said turning lever, said driver being provided with a driver cam arranged at a radial distance from said rotary axis, said turning member having a coulisse in which said driver cam runs during rotation of said driver; an end switch arranged to switch off said electric motor when after a rotation of said driver for approximately 180° said driver cam assumes one of two end rotary positions located on a straight line intersecting said rotary axis of said driver and said turning axis of said turning member, said coulisse being formed so that said turning member in each end rotary position of said driver cam is turnable by manual actuation of the blocking button through said turning lever by said driver cam to one of two end turning positions, and during rotation of said driver cam from said one end rotary position to another end rotary position said turning lever is turned to one or another end turning position; and an overloading coupling which fixedly connects said turning member and said turning lever, said overloading coupling being formed so that said fixed connection of said turning member and said turning lever is interrupted when a torque applied to said turning lever exceeds a predetermined value.

2. An electric motor operated actuating device as defined in claim 1, wherein said overloading coupling has a plurality of arresting elements and a plurality of arresting recesses in which said arresting elements are engageable under the action of a spring force, said arresting recesses being formed so that said arresting elements move out of said arresting recesses under the action of an overloading torque applied to said turning lever; said overloading coupling further including arresting springs applying the spring force to said arresting elements, said turning lever and said turning member having facing end surfaces in which said arresting recesses and said arresting elements with said arresting springs are arranged.

3. An electric motor operated actuating device as defined in claim 2, and further comprising a housing, said turning lever having a bearing pin which is coaxial with said turning axis and is turnably supported on said housing, said bearing pin having axial openings provided in an end surface which faces said turning member and formed for receiving said arresting springs and said arresting elements.

4. An electric motor operated actuating device as defined in claim 1, wherein said driver is formed as a driver disc, said end switch including a plurality of contact springs which are electrically connected with one another and held on said driver disc, and a plurality of contact paths which are electrically isolated from one another and are stationary relative to said driver disc, said contact springs abutting against said contact paths.

5. An electric motor operated actuating device as defined in claim 4, wherein said end switch has three concentrically arranged said contact paths and a slider provided with three said contact springs running on said contact paths, one of said contact paths extending over a circumferential angle over 360° and forming a full contact path, while two other contact paths extending each over a circumferential angle of 180° and forming semi-circular contact paths arranged opposite to one another, so that alternatingly in the both end rotary positions of said driver cam located on said driver disc one of said contact springs runs over an associated one of said contact paths while another of said contact springs runs on another associated one of said contact paths, said electric motor being formed as a direct current motor and being connected with a first potential of a direct voltage source, while a second potential of the direct voltage source is selectively connectable with one of said semi-circular contact paths.

6. An electric motor operated actuating device as defined in claim 5, wherein said first potential of said direct voltage source is a minus potential while said second potential of said direct voltage source is a plus potential.

7. An electric motor operated actuating device as defined in claim 5, and further comprising a control electronic circuit provided with two outputs connected each with one of said semi-circular contact paths and three inputs including two inputs which are connectable by the door key selectively with the second direct voltage potential; and a sensor which senses a position of said turning member and is connected with a third of said inputs of said control electronic circuit.

8. An electric motor operated actuating device as defined in claim 7, wherein said sensor is formed as an electric position switch which connects said third input of said control electronic circuit with the first direct voltage potential and closes in one of the turning end positions of said turning member.

9. An electric motor operated actuating device as defined in claim 8, wherein said position switch has a contact bridge arranged on said turning member which in one of the turning end positions of the turning member connects two spatial stationary contacts which are each connected to said third input of said control electronic circuit and to the first direct voltage potential.

10. An electric motor operated actuating device for a blocking button of a door lock for central locking and unlocking of doors of a motor vehicle, comprising an electric motor actuatable by a door key and provided with a driven shaft; a turning lever connectable with the blocking button for transferring the blocking button to a blocking position which locks the door lock and to an unblocking position which releases the door lock; a transmission arranged between said electric motor and said turning lever and converting a rotary movement of said driven shaft of said electric motor into a turning movement of said turning lever, said transmission including a turning member fixedly connected with said turning lever and turnable about a turning axis of said turning lever, and a driver driven by said electric motor and rotatable about a rotary axis extending parallel to said turning axis of said turning lever, said driver being provided with a driver cam arranged at a radial distance from said rotary axis, said turning member having a coulisse in which said driver cam runs during rotation of said driver; an end switch arranged to switch off said electric motor when after a rotation of said driver for approximately 180° said driver cam assumes one of two end rotary positions located on a straight line intersecting said rotary axis of said driver and said turning axis of said turning member, said coulisse being formed so that said turning member in each end rotary position of said driver cam is turnable by manual actuation of the blocking button through said turning lever by said driver cam to one of two end turning positions, and during rotation of said driver cam from said one end rotary position to another end rotary position said turning lever is turned to one or another end turning position, said driver being formed as a driver disc, said turning member being formed as a driver fork which is arranged relatively to said driver disc so that said rotary axis of said driver disc is located inside an opening of said driver fork which opening forms a coulisse, said driver cam during rotation of said driver disc being turned over a base of said opening of said fork and moving out of said opening, said driver cam in its both end rotary positions being located near the base of said opening and moving out of said opening, said driver fork having driver fork tongues limited by having inner flanks which limit said opening and forming convexly curved control curves for transferring said driver fork to its both end turning positions, said base of said opening of said driver fork being expanded in a turning direction of said driver fork, for a turning movement of said driver fork which is not hindered by said driver cam.

* * * * *